United States Patent [19]

Yamamoto et al.

[11] Patent Number: 4,884,602

[45] Date of Patent: Dec. 5, 1989

[54] APPARATUS FOR FILLING GRANULAR SUBSTANCE INTO HARD GELATIN CAPSULES

[75] Inventors: Taizo Yamamoto, Osaka; Hirokazu Konishi, Sakurai, both of Japan

[73] Assignee: Nippon Elanco Kabushiki Kaisha, Osaka, Japan

[21] Appl. No.: 208,075

[22] Filed: Jun. 17, 1988

[30] Foreign Application Priority Data

Jun. 18, 1987 [JP] Japan ..... 62-153034

[51] Int. Cl.[4] ..... B65B 3/10

[52] U.S. Cl. ..... 141/242; 53/560; 141/235; 141/67; 141/238

[58] Field of Search ..... 141/11, 12, 67, 71, 141/81, 234, 235, 237, 238, 240, 242, 246, 266; 53/560

[56] References Cited

U.S. PATENT DOCUMENTS

| | | | |
|---|---|---|---|
| 332,204 | 12/1885 | Krehbiel | 141/238 |
| 1,294,579 | 2/1919 | Waring | 141/242 |
| 1,579,947 | 4/1926 | Kilpatrick | 141/240 |
| 1,675,741 | 7/1928 | Waring | 141/242 X |
| 2,322,169 | 6/1943 | Smith | 141/240 X |
| 2,646,912 | 7/1953 | Reveno | 141/246 X |
| 2,749,005 | 6/1956 | Plusquellic | 141/242 X |
| 2,857,082 | 10/1958 | Perkins | 141/238 X |
| 3,380,633 | 4/1968 | DuBois | 141/238 |
| 3,695,486 | 10/1972 | Warner | 141/242 X |
| 4,398,578 | 8/1983 | Walters et al. | 141/238 |

FOREIGN PATENT DOCUMENTS

| | | | |
|---|---|---|---|
| 474695 | 6/1951 | Canada | 141/237 |

*Primary Examiner*—Ernest G. Cusick

*Attorney, Agent, or Firm*—Cushman, Darby & Cushman

[57] ABSTRACT

In a system for filling granular material into hard gelatin capsule wherein the granular material is portioned to a predetermined quantity by volume in a metering chamber and the portioned granular material mostly gravitates to a body of the hard gelatin capsule positioned beneath the metering chamber, an artificial force is exerted by a pusher rod on the granular material remaining in the metering chamber after the beginning of the gravitation. There also is an improved system for adjusting the capacity of the metering chamber. The improvements result in a greatly increased number of capsules which may be handled and filled at a time, a reduction in time required for the process and correspondingly in area occupied by the machine, and a remarkable improvement in the productivity. The uniformity and accuracy in the quantity of the granular material actually filled in the capsule are also remarkably improved.

3 Claims, 7 Drawing Sheets

APPARATUS FOR FILLING GRANULAR SUBSTANCE INTO HARD GELATIN CAPSULES

BACKGROUND OF THE INVENTION

1. Field of the Invention

The present invention relates to a system for filling granular material to hard capsules. More particularly, it is concerned with a method and an apparatus for filling bodies of medicinal hard capsules with a predetermined quantity of granular material such as granules or fine granules. The capsules are usually made of gelatin and mated in cap/body prelocked combination but are separated temporarily for the filling operation.

2. Description of the Prior Art

Roughly classified, there are three widely known systems for successively filling the conventional medicinal hard gelatin capsules with a predetermined quantity of medicinal substance or food material, depending on the physical properties of the material to be filled. The first of which is called as "Die Compression System" and is employed mainly for filling powdery medicine. The second one is "Gravitation System" which is applied to filling granular materials such as granules and fine granules. And the last one is "Pumping Unit System" employed for filling liquid.

Of these three systems, a capsule filling machine according to the "Gravitation System" is almost similar to that of the "Die Compression System" in its mechanical aspects. The application of the "Gravitation System" machine is however restricted to the granular material, such as, granules and fine granules which have excellent fluidity, and the machine is hardly applicable to the handling of the powdery material which has poor fluidity. The machine is generally composed of a metering chamber of a predetermined capacity provided on its metering disk. The granular material piled up on the upper surface of the disk is gravitated down into the chamber wherein the material is portioned. In the next step, the portioned material in the metering chamber is then allowed to fall down into the body of the hard gelatin capsule positioned under the outlet of the metering chamber with virtually no artificial force.

Even in the case of the granular material of excellent fluidity, the conventional "Gravitation System" machine is however still unsatisfactory, if an extremely high standard of accuracy and small variance in the quantity of the material actually filled in the capsule are imposed. Namely, so-called bridging of the material may sometimes be formed at an inlet of the metering chamber, in the metering chamber itself and at its outlet during the gravitational travel of the material from the upper surface of the metering disk down to the metering chamber and from the chamber into the body of the capsule to invite an inaccurate portioning or an irregular transposition of the material.

Therefore, in the conventional machine, all of the inlet of the metering chamber, the metering chamber itself and its outlet have heretofore been usually designed as widely as possible in order to prevent the bridging of the granular material to be filled.

The proposed wide design of the inlet of the metering chamber, the metering chamber itself and its outlet, however, means occupation of a large horizontal span by these components, and results in a limitation on the number of the components such as metering chambers for unit area of the capsule filling machine. This in turn reflects on an inconvenience of lowering of the filling (capsule handling) capacity for unit time, i.e., productivity of the machine.

Furthermore, in the conventional machine, the adjustment on the capacity of the metering chamber is usually performed by lateral insertion of a capacity-restricting means, for instance, a comb-teeth type device, into the metering chamber. Application of this type of adjustment is, however, restricted to a machine having metering chambers of just two rows at most. Therefore, the adjustment in a machine having the chambers in three or more rows must have been made by interchanging the metering disks of various thickness.

OBJECT AND SUMMARY OF THE INVENTION

It is therefore the primary object of the present invention to provide an improved system for filling hard gelatin capsules with a granular material.

It is another object of the present invention to provide an improved method and apparatus which makes adjustment of the quantity of the material to be filled very easy.

The present invention can provide an unprecedent accuracy in the filling operation by minimizing variance in the quantity of the material to be filled which would otherwise be caused by the bridging in the apparatus.

Furthermore the present invention can provide a method and an apparatus which have made a remarkable improvement in capsule handling and filling capacity.

These and other objects of the present invention and attendant advantages thereof will be described in more detail by way of example referring to the attached drawings.

According to the present invention, there is provided, in a method for filling hard gelatin capsules with a granular material wherein the granular material is portioned to a predetermined quantity by volume in a metering chamber and the portioned granular material mostly gravitates down into bodies of the hard gelatin capsules positioned beneath the metering chamber, the method which comprises adding an artificial force on the granular material remaining in the metering chamber after the beginning of said gravitation.

In a preferred mode of the present method, said artificial force is added immediately after the beginning of the gravitation and is a direct pressure on the granular material to be filled. The artificial force is usually a mechanical force and the gravitation means falling down. The granular material may either be granules or fine granules.

According to another aspect of the present invention, there is provided, in a capsule filling machine wherein a predetermined quantity of granular material is portioned by volume in a metering chamber and then gravitated down into a body of hard gelatin capsule positioned beneath the metering chamber, the apparatus which comprises a means for adjusting said predetermined quantity by varying the capacity of said metering chamber formed by combining a bottomless cylindrical through-hole provided on a metering table of a given thickness with a tubular body telescopically engaging with the throughhole; and a pusher rod capable of moving reciprocatively to project its tip into said metering chamber and then to promptly retract from the upper opening of the metering chamber during the portioning operation in synchronism with the entire filling operation.

The appratus may further comprises; a means for driving an integral body of a hopper as a container for the granular material and a pusher housing, the latter serving as a container of the pusher rod and also as a shutter for the former; a means for driving a shutter plate which closes the outlet opening of the metering chamber during the portioning operation; a means for actuating the pusher rod including a link/locker arm assembly; a combination of a common vertical shaft which supports three cams, cam followers each engaging with each of said cams and three rods each connected to each of said cam followers to give said means individual horizontal reciprocating movements; and a combination supporting these components, composed of a bed, a column erected thereon and a bearing block supported by the column whose height is adjustable by a threaded connection therebetween.

By embodying the present invention, the occurence of the bridging of the granular material in the metering chamber will effectively be prevented because an artificial force is exerted on the material remaining in the metering chamber after the begining of gravitation. And a means for exerting the artificial force may be simple and reliable if constructed in accordance with the present invention.

Meanwhile, adjustment of the capacity of the metering chamber of the present invention is also simple and versatile for broad application. The capacity corresponds to the quantity of the granular material actually filled in the capsule. The adjustment may even be effected during the operation, not to mention the shut-off period. Greatly increased numbers of capsules may be handled and filled at a time. This means a reduction in time required for the process and correspondingly in area occupied by the machine, and a remarkable improvement in the productivity.

The uniformity and accuracy in the quantity of the granular material actually filled in the capsule will therefore be remarkably improved by the present invention.

DESCRIPTION OF THE PREFERRED EMBODIMENT

Structure of the Apparatus

Figure 1:
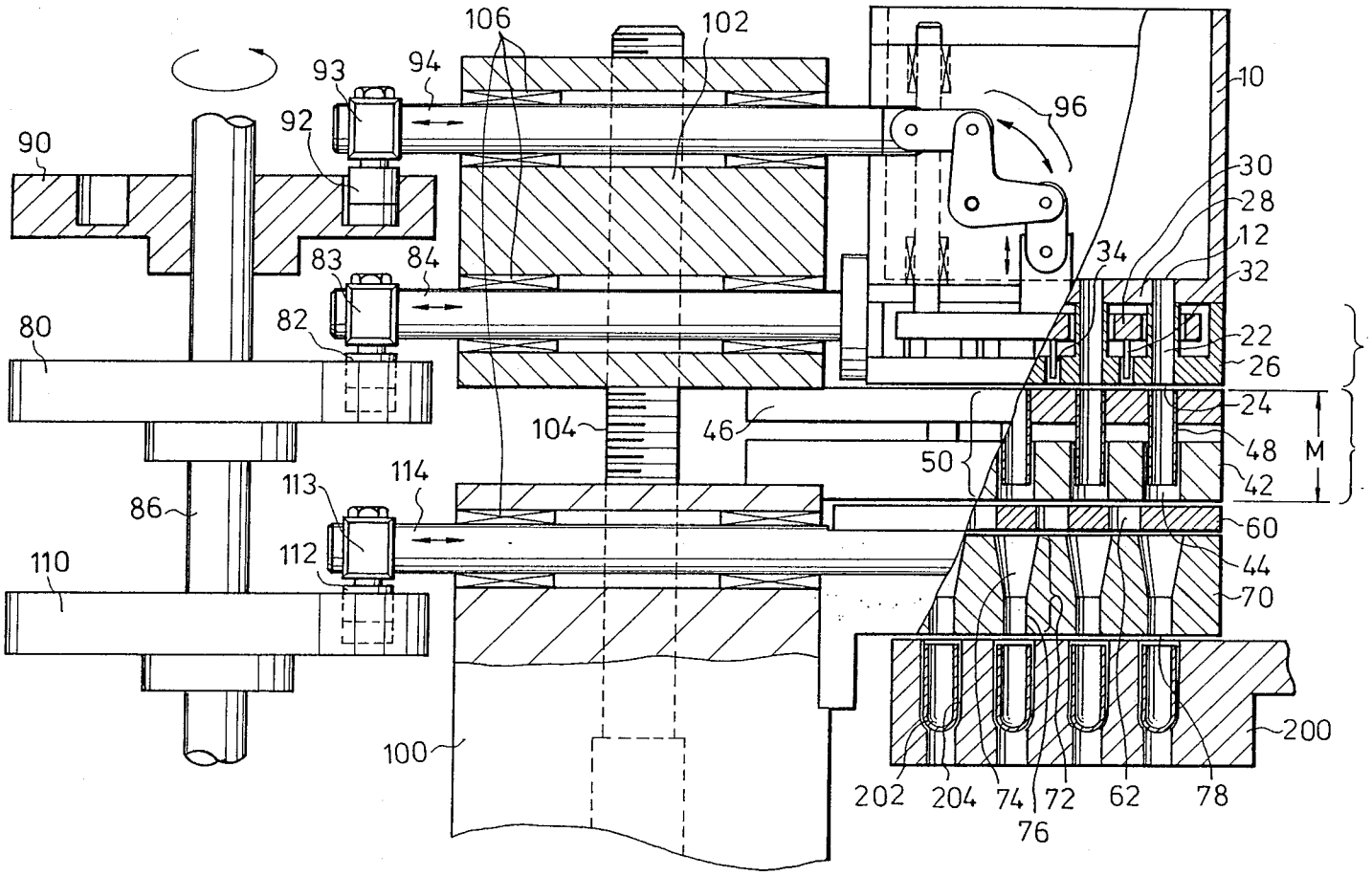
FIG. 1 is a side sectional elevational view of the capsule filling machine built in accordance with the present invention with its essential parts cut-out for illustration.
Figure 2:
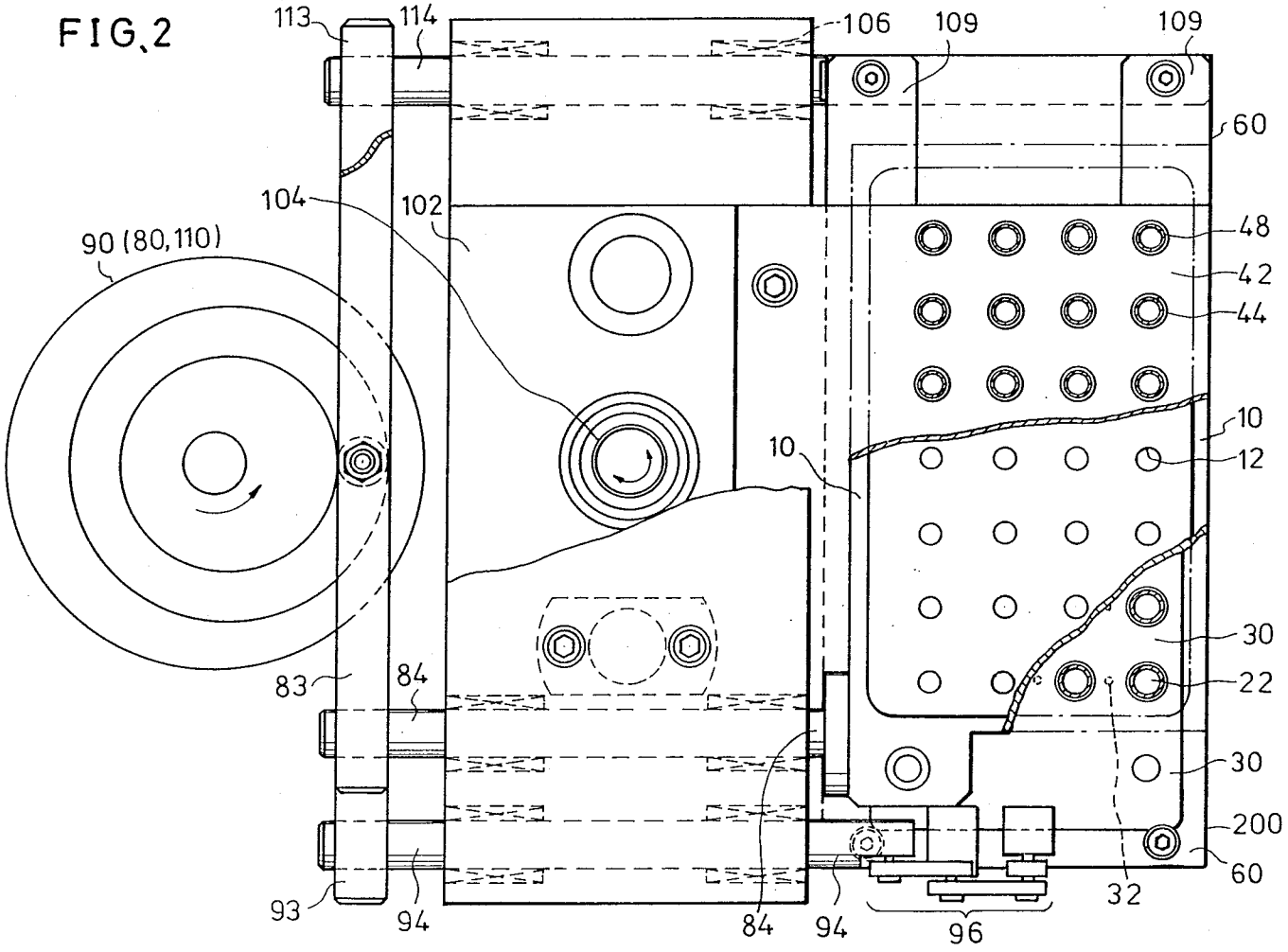
FIG. 2 is a plan view of apparatus as shown in FIG. 1.
Figure 4:
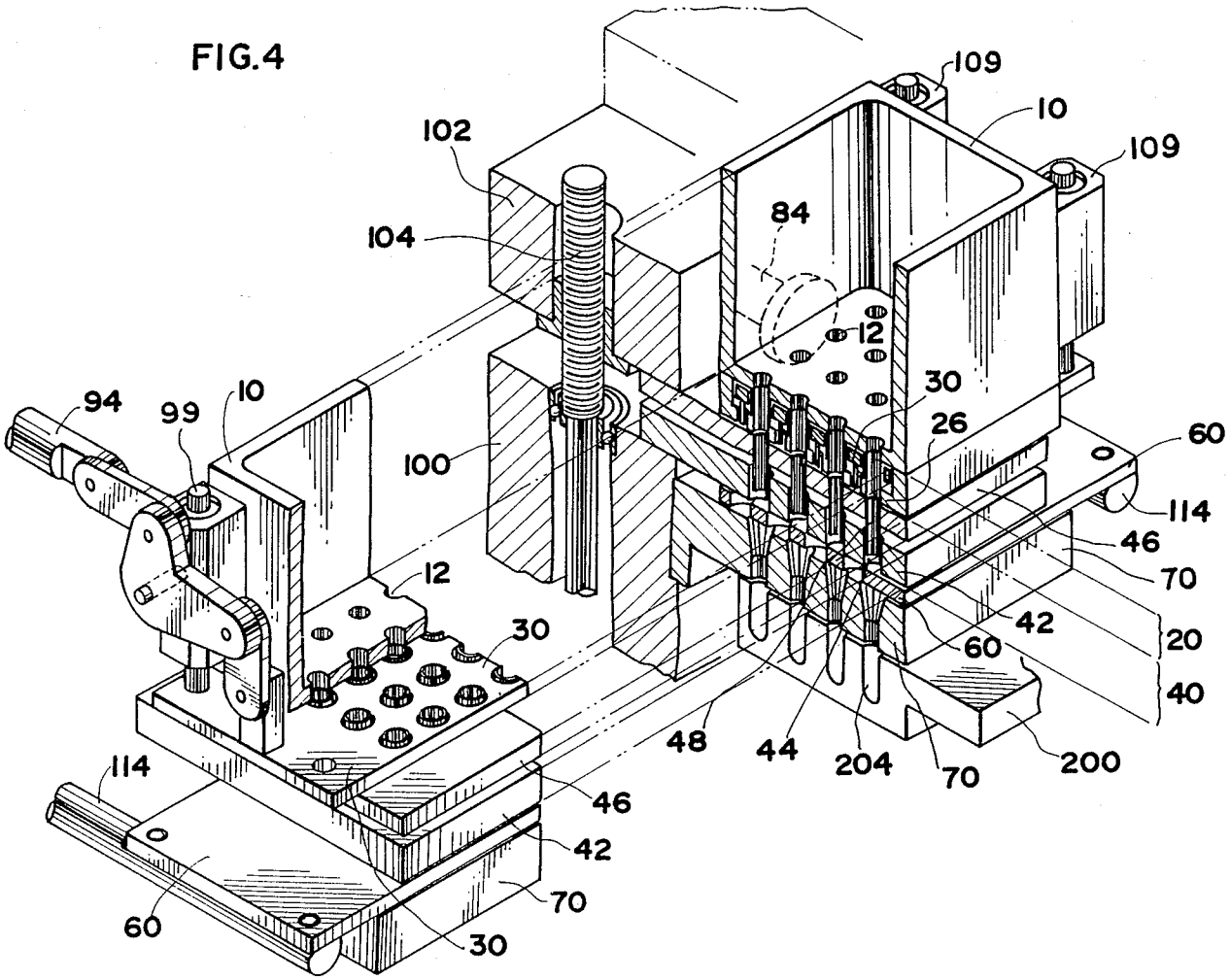
FIG. 4 is an exploded perspective view of a part of the apparatus as shown in FIG. 1.

As shown in FIGS. 1, 2 and 4, the capsule filling machine of the present invention includes a vertical combination of a a hopper 10, pusher rod housing 20, a metering chamber assembly 40, a shutter plate 60, a filling chute array 70, disposed from the top to the bottom. The hopper 10 accommodates granular materials such as granules and fine granules, and has a bottom plate on which a regularly arranged (for example, 4×7 rows) plurality of supply outlets 12 for the granular material are provided.

The pusher rod housing 20 is fixed integrally to the bottom of said hopper 10 and has a plurality of supply paths 22 which correspond to the outlets 12 of the hopper 10. Bottom openings 24 of the supply paths 22 reach the upper surface of the metering chamber assembly 40 at its bottom plate 26 which also serves as an upper shutter plate. The part of the pusher rod housing 20 except the space occupied by the supply paths 22, indicated by numeral 28 in the drawings, accomodates a pusher rod base 30 which supports downwardly projecting pusher rods 32. Its arrangement is similar to but in a horizontally staggered relationship with that of the supply paths 22. The pusher rods 32 are capable of piercing through the openings 34 of the bottom plate 26 and into the metering chambers 50.

The metering chamber assembly 40 comprises a lower metering table 42 provided with a plurality of through holes 44 and an upper metering table 46 holding a downwardly projecting plurality of tubular bodies 48. Each of the through holes 44 tightly accomodates the corresponding one of the tubular bodies 48 which are telescopically engaging with the through holes to form a metering chambers 50 of adjustable capacity.

The shutter plate 60 is provided with a plurality of regularly arranged through holes 62 of approximately the same diameter of those in the lower metering table 42, and is capable of intermittent reciprocating movement in the horizontal direction. The filling chute array 70 has a plurality of filling chutes 72 having a space consisting of combined frust-conical 74 and interconnected cylindrical 76 parts. Each of the outlets 78 of the cylindrical parts 76 always confronts the corresponding one of bodies 202 of the capsules ready for being filled which are accomodated by a pocket 204 provided on a a capsule body carrier 200 which is capable of horizontal reciprocating movement to bring the capsule bodies 202 beneath the array 70.

The integral body of the hopper 10 and the pusher rod housing 20 reciprocates horizontally, i.e., laterally on the plane of FIG. 1, at a predetermined period and stroke by a driving means composed of a cam 80, a cam follower 82, a lateral arm 83 and a connecting rod 84. The cam 80 rotates on a cam shaft 86 which is driven by an unshown motor with an appropriate transmission means at a predetermined rotational frequency.

The horizontal reciprocative movement of the integral body 10/20 makes each of the bottom openings 24 of the supply paths 22 confronts the corresponding one of the metering chambers 50 situated beneath the pusher rod housing 20, and alternately puts the former aside the latter.

Each of the pusher rods 32 is capable of an intermittent vertical movement together with the pusher rod base 30 at a predetermined period and stroke. The vertical movement is brought by converting a horizontal movement of a connecting rod 94 by rocking movements of a link and rocker assembly 96, and the connecting rod 94 is horizontally reciprocated by another lateral arm 93 pivoting another cam follower 92, which engages with a cam 90 held by the shaft 86 to rotate together with the cam 80.

Each of the metering chambers 50 has a space of adjustable capacity which may be determined by the distance M between the upper metering table 46 and the lower metering table 42. Since the distance is equal to that of a stationary bed 100 and an bearing block 102, it is arbitrarily adjustable by rotating a threaded part of a column 104 which connects the bed 100 with the bearing block 102. The vertical movement, i.e., up/down movement on the plane of FIG. 1, of the bearing block 102 accompanies that of the integral body 10/20 together with the upper metering table 46 with respect to the lower metering table table 42 because the connecting rod 84 is also held by the bearing block 102. Therefore, the adjustment of the height of the block 102 immediately makes the adjustment of the filling quantity of the granular material in the capsules. The stroke of the vertical movement of the bearing block 102 is however designed to be small as compared with the thickness of the lower metering table 42 and, even at maximum, not to exceed the thickness as illustrated in the drawings.

The shutter plate 60 is placed close to the lower metering table 42 and its reciprocating horizontal movement is effected by a driving means composed of a cam 110 on the shaft 86, a cam follower 112 and a connecting rod 114. Since the connecting rod 114 reciprocates while being supported by the stationary bed 100, the shutter plate 60 periodically reciprocates just in the horizontal direction to open and close bottom outlets of the metering chambers 50.

Each of the connecting rods 84, 94 and 114 is supported on the corresponding bearing block 100 or 102 by each of linear bearings 106, respectively.

The previously described configuration of the filling chutes 72 of a combination of frust-conical 74 part and interconnected cylindrical 76 part with a little broader top inlets and a little narrower bottom outlets is preferred for the smooth flow of the material to be filled down to the capsule bodies 202. However, the bottom outlets 78 should not be designed too narrow in order to avoid possible bridging at this spot.

As previously described and illustrated in the drawing, the outlets 78 always confront the capsule bodies 202 which are held in a regular alignment with their open ends up by pockets 204 of the capsule body carrier 200. The capsule body carrier 200 is a component of a related capsule rectifying and delivering apparatus which constitutes a consolidated capsule processing machine. It serves to intermittently deliver a predetermined number of capsule bodies beneath the filling chute array 70 and subsequently fetch them therefrom for the next operation in synchronism with the filling operation. The related apparatus may be of any conventional type, and therefore detailed illustration thereof is omitted from the description.

OPERATION

In the following, the concrete process embodying the method of the present invention and the function/operation of each of the components of the disclosed apparatus will be illustrated stepwisely in more detail by referring to FIG. 3 of the drawings.

(A): PORTIONING IN THE METERING CHAMBERS (FIG. 3A)

Figure 3A:
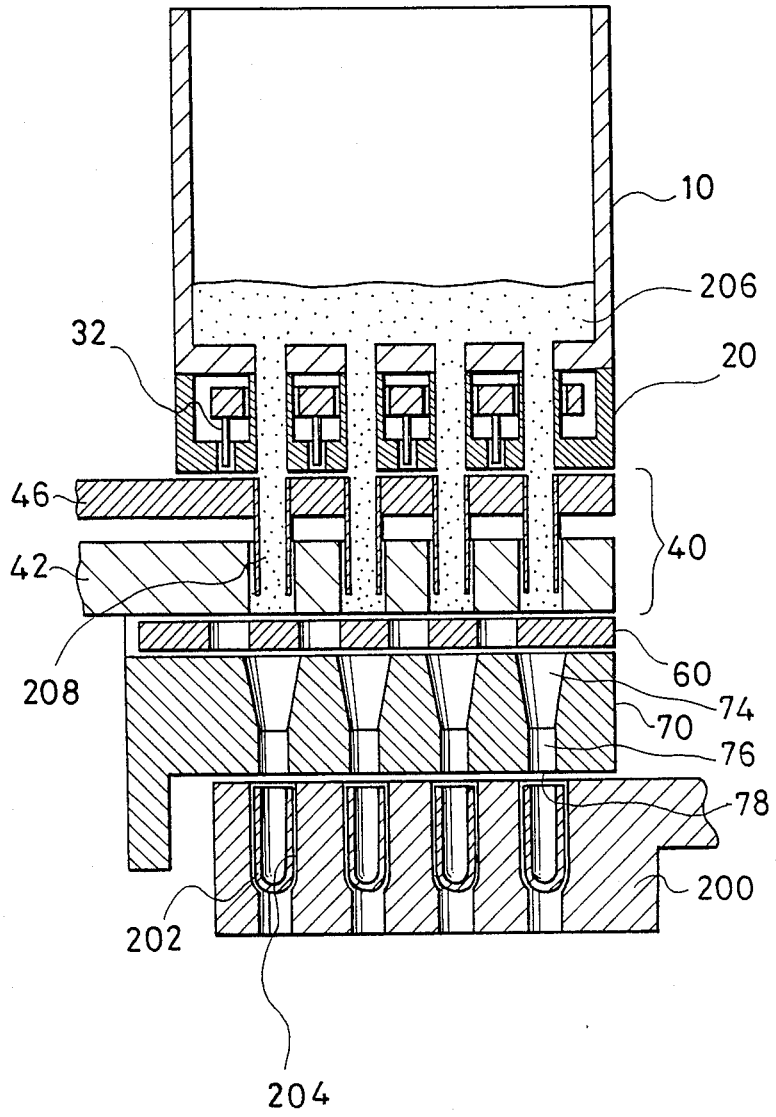
FIGS. 3A, 3B, 3C and 3D each is a schematic view stepwisely illustrating the capsule filling operation performed in the appratus of the present invention.
Figure 3:
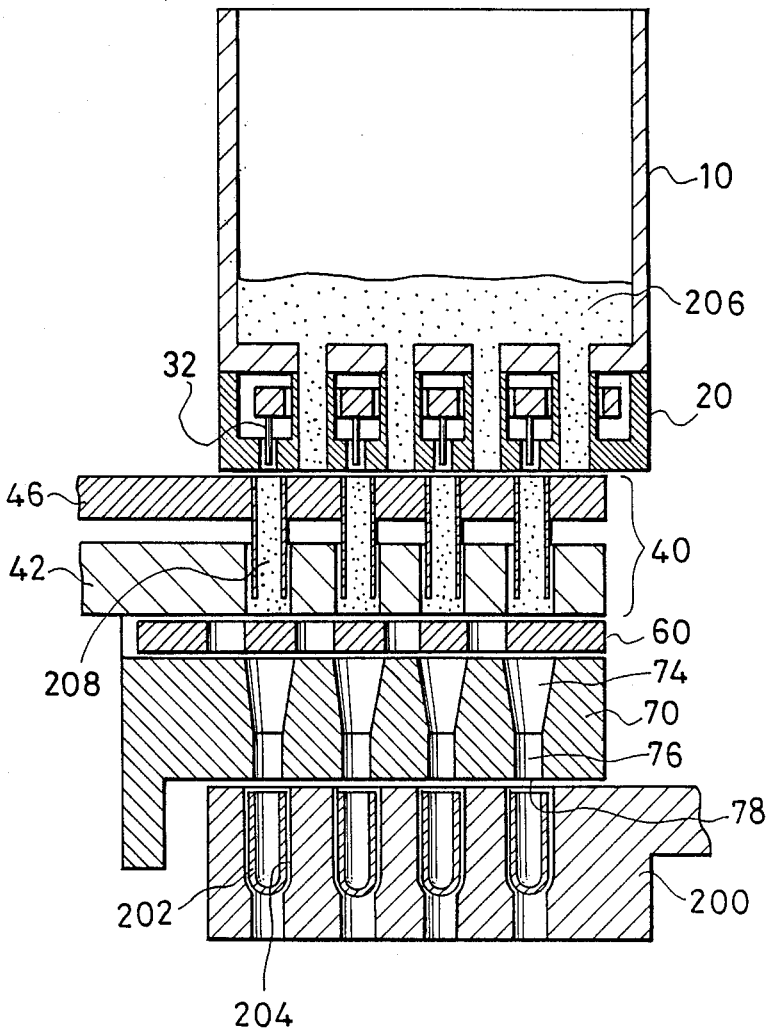

In a sector between specified angular positions of the shaft 86, the cams 80 and 110 each brings the pusher rod housing 20 and the shutter plate 60 to their right extreme as illustrated in FIG. 3A. In this step, the upper openings of the metering chambers 50 and the bottom openings 24 of the supply paths 22 are in a vertical alignment while the bottom openings of the metering chambers 50 are closed by the shutter plate 60. The cam 90 moves the pusher rod base 30 upwards and to hold the pusher rods 32 at their retracted positions.

The relative positions of these components enables the granular material 206, which has been stored in the hopper 10, gravitate down into the metering chambers 50 through the supplying outlets 12 of the hopper 10. Since this portioning operation of the material 206 in the metering chambers relies primarily on gravitation with no artificial force, the supplying outlets 12 of the hopper 10 should be designed so that the fluidity of the granular material would never be affected. Although not specifically illustrated in the drawing, an upwardly flared elliptic shape or elongated circle will be preferred in general because such a shape permits an easy-to-flow design of the configuration of the supplying outlets 12.

(B): METERING STEP (FIG. 3B)

The cam follower 82 brought to a subsequent specified sector of the cam 80 effects a horizontal displacement of the integral body of the hopper 10 and pusher rod housing 20 to the right on the drawing. In this step, the upper openings of the metering chambers 50 are closed by the upper metering plate 46 to shut the supplying paths 22 to make each of the metering chambers 50 an independent space for the portioning. The pusher rod housing 20 in this position also serves to put aside the supplying paths 22 which would otherwise connect the hopper 10 to the metering chamber assembly 40. Instead, the pusher rods 32 and the corresponding openings 34 confront the upper openings of the metering chambers 50.

The adjustment of the capacity of the chambers 50, hence, the actual filling quantity of the material can arbitrarily be made by manipulating the threaded part of the column 104 as previously described.

(C): FILLING STEP (FIG. 3C)

In the next sector of the cam 110, the shutter plate 60 displaces to the right on the drawing and the through holes 62 connect the metering chambers 50 and filling chutes 72 by the accompanying movement of the cam follower 112, the lateral arm 113 and the connecting rod 114. Namely, each of the metering chambers 50 is in vertical alignment with the corresponding one of the through holes 62 and filling chutes 72. Therefore, the granular material 208 stored in the metering chambers 50 gravitates down to the filling chute 72 and then to bodies 202 of the capsules which are waiting beneath the filling chute 72.

(D): BRIDGE DISINTEGRATING STEP (FIG. 3D)

Figure 3C:
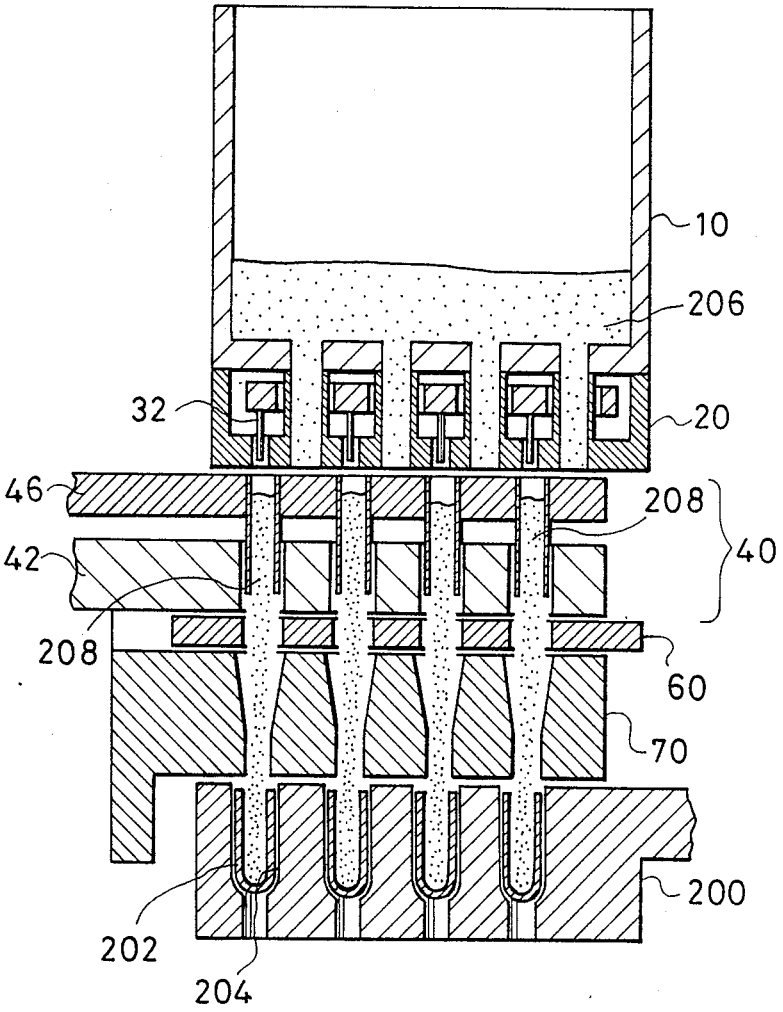
Figure 3D:
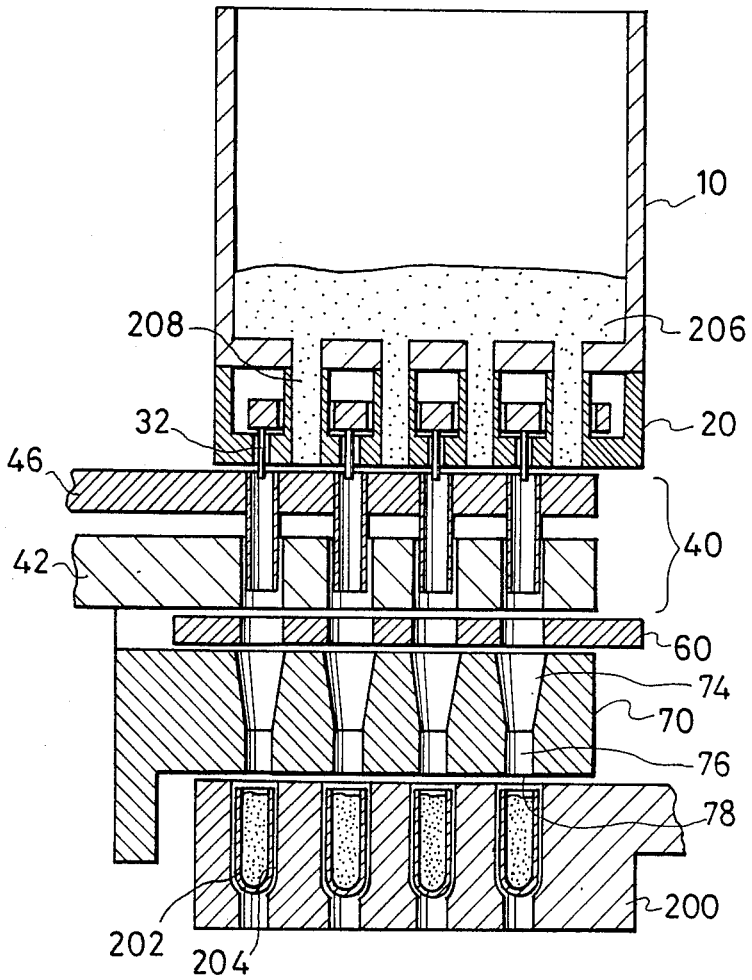

In most cases, the whole quantity of the granular material to be filled 208 stored in the metering chambers 50 (FIG. 3C) gravitates down into the capsule bodies 202 rapidly in the state illustrated in FIG. 3(C) to complete the filling operation. However, the granular material 208 stored in the metering chambers 50 might sometimes form a bridge or bridges in the metering chambers 50. In such cases, immediately after the begining of the filling operation of the granular material 208, the cam follower 92 at a specified angular position of the cam 90 actuates the link/rocker assembly 96 to move the pusher base 30 and the pusher rods 32 downward. Even if a bridge is formed in the metering chambers 50, a simple touch of the tips of the pusher rods 32 can well serve to disintegrate it and a smooth flowing of the granular material by gravitation will be assured. The described downward movement of the pusher rods 32 to the metering chambers 50 is preferably performed immediately after the beginning of the flowing of the granular material 208 in the metering chambers 50 while their bottom outlets open.

As the shaft 86 rotates to the next few degree in its angular position, the cam follower 94 actuate the link-/rocker assembly 96 to move the pusher base 30 to quickly retract the pusher rods 32 to their original positions.

If this reciprocating movement of the pusher rods 32 is too slow and a substantial time period is required for the movement, a disadvantage results from the correspondingly long time required for completing the operation, i.e. poor productivity of the apparatus. Meanwhile, a premature downward movement of the pusher rods 32, i.e., that before the opening of the bottom outlets of the metering chamber 50, is also not preferable because it might result in a kind of a tamping operation on the granular material 208 stored in the metering chamber 50.

In a design of a practical embodiment, the stroke of the reciprocating movement of the pusher rods 32 of from 2 to 7 mm, preferably from 3 to 5 mm, is sufficient. The stroke corresponds to an inserting depth of 2–4 mm of the rods into the inlet openings of the metering chambers 50 and is enough for fulfiling the object of disintegrating the bridge.

No limitation is imposed on the shape of the pusher rods 32 but it is suitable to make their section 0.1–0.6, and preferably, 0.2–0.4 of the cross-sectional area of the inlet openings of the metering chambers 50.

After the restoration of the pusher rods 32 to their original positions and the completion of the gravitation of the granular material 208 in the metering chambers 50 down to the capsules, the integral body 10/20 and the shutter plate 60 return to restore the position ilustrated in FIG. 3A. The time required for the described single cycle is about 1–2 seconds.

As previously described, the filled capsule bodies 202 in the capsule body carrier 200 will then be processed in a related apparatus to be mated with the corresponding caps automatically to produce finished capsule products.

What we claim is:

1. In capsule filling apparatus wherein in a filling operation a predetermined quantity of granular material is portioned by volume in a metering chamber and then gravitated down into hard gelatin capsule bodies positioned to under the chamber, the improvements comprising:

a metering chamber assembly including a metering table having a through hole therein for gravitational flow of material therethrough into a capsule body, shutter means for closing and opening the lower end of said hole, and a tubular body in telescoping engagement with said hole from the upper end of said hole;

a horizontally-reciprocable hopper having a bottom outlet moving into and out of alignment with the upper end of said tubular body to open and close said tubular body;

a supporting column, a bearing block supported thereon and a threaded connection therebetween for adjusting the height of said block;

means carrying said hopper and said tubular body on said block for adjusting the extent of said telescoping engagement to adjust the capacity of said metering chamber assembly and accordingly said predetermined quantity;

push rod means carried by said hopper movable into and out of alignment with the upper end of said tubular body, said push rod means being vertically reciprocable and movable into said upper end of said tubular body when said hopper outlet is out of alignment therewith to disintegrate any bridging of the material during a filling operation and out of said upper end during a portioning; and cam means for horizontally reciprocating said hopper and said push rod means and for vertically reciprocating said push rod means in synchronism with the horizontal reciprocation of said hopper for a portioning and filling operation.

2. The apparatus as claimed in claim 1 wherein vertical reciprocation of the pusher rod means occurs immediately after the beginning of the gravitation.

3. The apparatus as claimed in claim 1 which includes a plurality of metering chamber assemblies and pusher rod means lined up together horizontally.

* * * * *